US009895818B2

(12) United States Patent
Wong

(10) Patent No.: US 9,895,818 B2
(45) Date of Patent: Feb. 20, 2018

(54) CUTTER COMBINATION DEVICE FOR FOODSTUFFS

(71) Applicant: KING'S FLAIR DEVELOPMENT LTD., Hong Kong (HK)

(72) Inventor: Siu Wah Wong, Hong Kong (HK)

(73) Assignee: KING'S FLAIR DEVELOPMENT LTD., Hong Kong (CN)

( * ) Notice: Subject to any disclaimer, the term of this patent is extended or adjusted under 35 U.S.C. 154(b) by 135 days.

(21) Appl. No.: 14/983,854

(22) Filed: Dec. 30, 2015

(65) Prior Publication Data

US 2016/0193741 A1 Jul. 7, 2016

Related U.S. Application Data

(60) Provisional application No. 62/099,427, filed on Jan. 2, 2015.

(51) Int. Cl.
*B26B 25/00* (2006.01)
*B26B 29/00* (2006.01)
*B26D 1/143* (2006.01)

(52) U.S. Cl.
CPC ..... *B26B 25/005* (2013.01); *B26B 29/00* (2013.01); *B26D 1/143* (2013.01)

(58) Field of Classification Search
CPC ..... B26B 25/005; B26B 29/00; B26D 1/143
See application file for complete search history.

(56) References Cited

U.S. PATENT DOCUMENTS

| | | | | |
|---|---|---|---|---|
| 7,363,710 | B2 * | 4/2008 | Kortleven | B26B 25/005 30/143 |
| 8,555,513 | B2 * | 10/2013 | Moreland | B26B 25/005 30/292 |
| 2004/0231475 | A1 * | 11/2004 | Cornfield | B26B 25/005 83/13 |
| 2005/0028388 | A1 * | 2/2005 | Liu | B26B 25/005 30/319 |
| 2010/0263217 | A1 * | 10/2010 | Baxter | A47J 9/00 30/287 |
| 2016/0193741 | A1 * | 7/2016 | Wong | B26B 25/005 30/287 |

FOREIGN PATENT DOCUMENTS

EP 3 040 170 A1 * 7/2016

* cited by examiner

*Primary Examiner* — Hwei C Payer
(74) *Attorney, Agent, or Firm* — Nyemaster Goode P.C.

(57) ABSTRACT

The present invention relates to a multi-functional cutting device for foodstuffs, especially for pizzas and herbs, which is easily transformable between a configuration adapted for cutting pizzas and a configuration adapted for cutting herbs. The cutting device of the present invention comprises covering members which, when detached from a main body, allow respective cutting means to be exposed to enable the cutting of foodstuffs. A locking mechanism for locking and unlocking the covering members is provided to ensure the attached one of the cutting means. The cutting device of the present invention can be disassembled effortlessly with easy access to the interior thereof.

19 Claims, 15 Drawing Sheets

CUTTER COMBINATION DEVICE FOR FOODSTUFFS

TECHNICAL FIELD OF THE INVENTION

This invention relates generally to a multi-functional cutter for foodstuff, particularly a cutter that is transformable between a configuration adapted for cutting pizzas and a configuration adapted for cutting herbs.

BACKGROUND OF THE INVENTION

Pizza cutters are currently available. A typical pizza cutter comprises a disk-shaped blade rotatably mounted on a handle. The user holds the handle and rolls the disk-shaped blade over a pizza in order to cut the pizza into pieces/slices. Also available are herb cutters, which have some similarity in structure to pizza cutters, in that they also have a handle with blades rotatably mounted thereon. What is different is that a typical herb cutter usually comprises a plurality of blades arranged in parallel, so as to facilitate the cutting of herbs. This difference is due to the fact that pizzas are usually cut into relatively larger pieces/slices while herbs are cut into smaller chips. As these two types of cutters are both frequently used in many occasions and often are used in combination when the pizza is consumed, it would be desirable if they can be combined into one device, which can be easily switched between a configuration adapted for cutting pizzas and a configuration adapted for cutting herbs.

In addition, one disadvantage of currently available pizza cutters and herb cutters is that, as there is usually a covering member protecting the hand of the user from being hurt by the blade(s), it is difficult to access and clean the interior of the cutter. Therefore, it would be desirable if there is a foodstuff cutter that allows effortless disassembling of the components enabling easy access to the interior of the cutter.

SUMMARY OF THE INVENTION

The present invention has a principle object of providing a multi-functional cutter for foodstuff, especially for pizzas and herbs, which is easily transformable between a configuration adapted for cutting pizzas and a configuration adapted for cutting herbs.

Another object of this invention is to provide a foodstuff cutter that can be disassembled effortlessly with easy access to the interior thereof.

This and other objects are satisfied by the present invention, which provides a cutting device for foodstuffs, comprising: at least one first cutting means and at least one second cutting means, both rotatably mounted on the main body portion and adapted for cutting respective target foodstuffs, and a cover detachably connected to the main body portion to define an interior space for accommodating the first cutting means and the second cutting means. The cover comprises a first covering member detachably attached to the main body portion and configured in such a manner that the attachment of the first covering member from the main body allows for exposure of at least part of the first cutting means to enable the cutting of foodstuffs; and a second covering member detachably attached to the main body portion and configured in such a manner that the detachment of the second covering member from the main body allows for exposure of at least part of the second cutting means to enable the cutting of foodstuffs. The first covering member and the second covering member are mounted on the main body portion in a way which permits the detachment of one or both of the first and second covering members from the main body portion.

In one embodiment of the present invention, the cutting device further comprises a locking mechanism arranged on the main body portion, the locking mechanism being displaceable among a first position, wherein the first covering member is allowed to be detached from the main body portion and the second covering member is prevented from being detached from the main body portion; a second position, wherein the second covering member is allowed to be detached from the main body portion and the first covering member is prevented from being detached from the main body portion; and a third position, wherein both the first covering member and the second covering member are allowed to be detached from the main body portion.

In one embodiment of the present invention, the main body portion comprises an annular frame having a top plate, a bottom plate and two opposite side plates connecting the top plate and the bottom plate, and the first cutting means and the second cutting means are arranged between the top plate and the bottom plate, wherein the first cutting means extends transversely beyond edges of the top and bottom plates at two opposite sides of the frame.

In one embodiment of the present invention, the first cutting means comprises a main cutting member rotatably mounted on a main axle extending upwardly from the bottom plate to protrude beyond the top plate, and the cutting of the foodstuffs is implemented by rotation of the main cutting member.

In one embodiment of the present invention, the second cutting means comprises a first auxiliary cutting member rotatably mounted on a first mounting plate extending outwardly from below an inner surface of the top plate, and the cutting of the foodstuffs is implemented by rotation of the first auxiliary cutting member. Preferably, the main cutting member is sized and configured to serve as a part of the second cutting means.

The second cutting means may further comprise a second auxiliary cutting member rotatably mounted on a second mounting plate extending outwardly from above an inner surface of the bottom plate on the same side of the frame as the first mounting plate, and the cutting of the foodstuffs is implemented by rotation of the first and second auxiliary cutting members.

In one embodiment of the present invention, each of the main cutting member, the first auxiliary cutting member and the second auxiliary cutting member is provided as a circular blade, wherein the main cutting member is sized and configured to extend transversely beyond the edges of the top and bottom plates at two opposite sides of the frame, and the first and second auxiliary cutting members are sized and configured such that they only extend transversely beyond the edges of the top and bottom plates on the same side of the frame as the first and second mounting plate.

In one embodiment of the present invention, the first covering member is formed to have a first cavity accommodating said at least part of the first cutting means, and the second covering member is formed to have a second cavity accommodating said at least part of the second cutting means.

In one embodiment of the present invention, a first top bulge is formed on a top inner surface of the first covering member, and a first bottom bulge is formed on a bottom inner surface of the first covering member, the first top bulge and the first bottom bulge being adapted to cooperate with the locking mechanism to prevent the first covering member from being detached from the main body portion when the locking mechanism is in the second position.

In one embodiment of the present invention, a second top bulge is formed on a top inner surface of the second covering member, and a second bottom bulge is formed on a bottom inner surface of the second covering member, the second top bulge and the second bottom bulge being adapted to cooperate with the locking mechanism to prevent the second covering member from being detached from the main body portion when the locking mechanism is in the first position.

In one embodiment of the present invention, the locking mechanism comprises a top locking member rotatably mounted on the main axle between the main cutting member and the top plate of the main body portion, the top locking member being adapted to engage with the first top bulge to prevent the first covering member from being detached from the main body portion when the locking mechanism is in the second position, and to engage with the second top bulge to prevent the second covering member from being detached from the main body portion when the locking mechanism is in the first position.

In one embodiment of the present invention, the locking mechanism comprises a bottom locking member rotatably mounted on the main axle between the main cutting member and the bottom plate of the main body portion, the bottom locking member being adapted to engage with the first bottom bulge to prevent the first covering member from being detached from the main body portion when the locking mechanism is in the second position, and to engage with the second bottom bulge to prevent the second covering member from being detached from the main body portion when the locking mechanism is in the first position.

In one embodiment of the present invention, the top locking member is configured to be disengaged from both the first top bulge and the second top bulge when the locking mechanism is in the third position, and the bottom locking member is configured to be disengaged from both the first bottom bulge and the second bottom bulge when the locking mechanism is in the third position.

In one embodiment of the present invention, each of the top locking member and the bottom locking member is provided as a circular sector having a respective arcuated tooth formed at an outer arcuated edge thereof to cooperate with the corresponding ones of the first top bulge, the second top bulge, the first bottom bulge and the second bottom bulge.

In one embodiment of the present invention, the locking mechanism further comprises a handle provided on top of the top plate of the main body portion, wherein the handle is configured to be rotatable around the main axle, and the rotation of the handle causes the rotation of the top locking member and the bottom locking member.

In one embodiment of the present invention, the handle is configured to be pivotal around an axis perpendicular to the main axle between an upstanding position, wherein the handle is rotatable around the main axle, and a lying position, wherein the handle is received in a recess formed on a top surface of the top plate of the main body portion.

In one embodiment of the present invention, the first covering member and the second covering member are attached to the main body portion by snap-fit.

In one embodiment of the present invention, indicators are provided on a top surface of the main body portion to respectively indicate the first, second and third positions of the locking mechanism.

DETAILED DESCRIPTION OF THE INVENTION

While this invention is illustrated and described in a preferred embodiment, the cutting device of the present invention may be produced in many different configurations, sizes, forms and materials.

Figure 1:
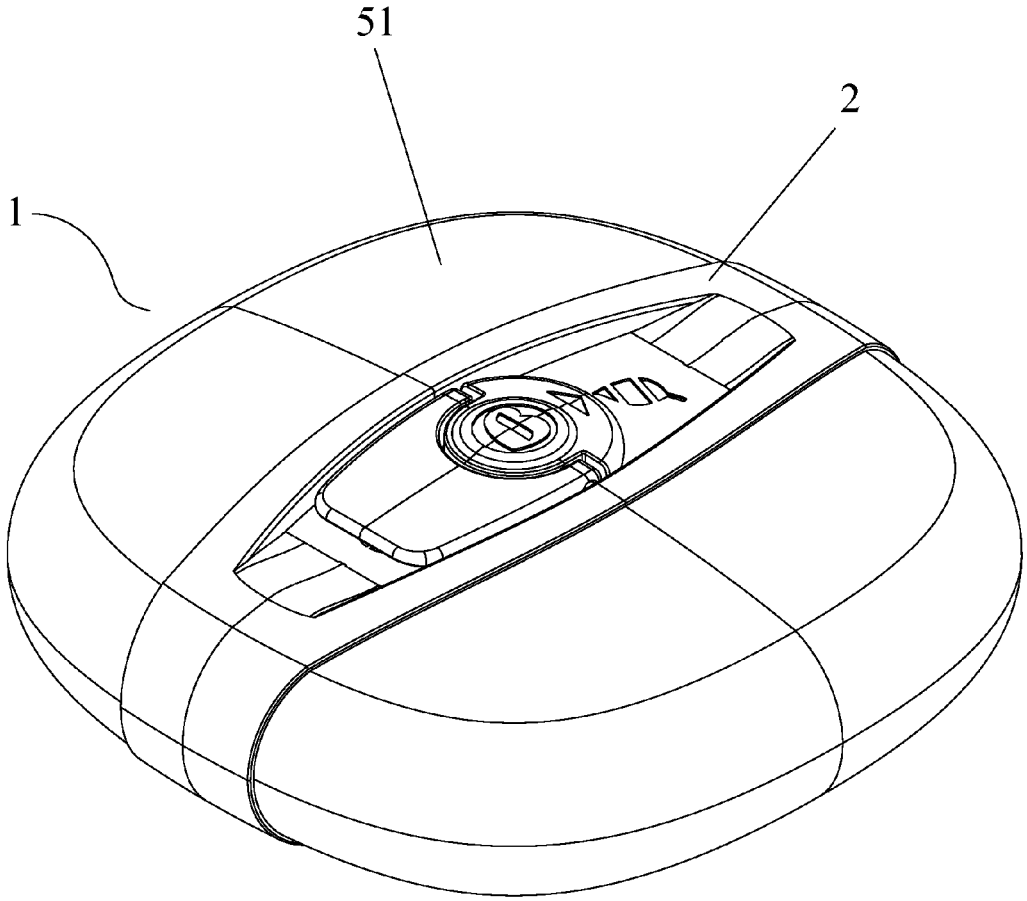
FIG. 1 is a perspective view of a cutting device according to an embodiment of the present invention.
Figure 2:
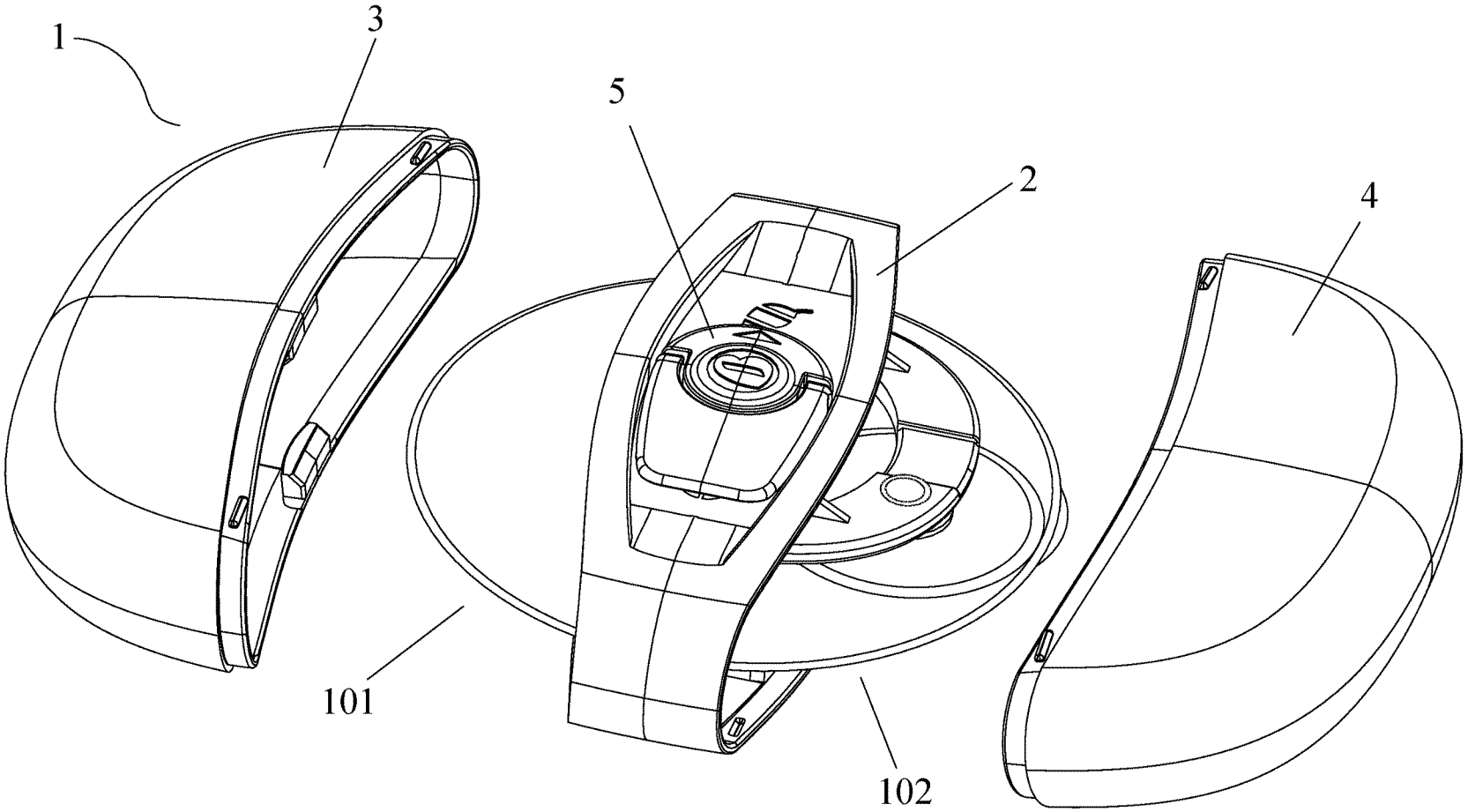
FIG. 2 is a perspective view of the cutting device shown in FIG. 1, with the first covering member and the second covering member detached from the main body portion.

Referring now to the drawings, FIGS. 1 and 2 illustrate in perspective views a cutting device 1 according to a preferred embodiment of the present invention. The cutting device 1 comprises a main body portion 2, a cover 51 comprising a first covering member 3 and a second covering member 4 that can be detachably attached to opposite sides of the main body portion 2, respectively. The cutting device 1 further comprises first cutting means 101 and second cutting means 102, and a locking mechanism 5. When the first covering member 3 and the second covering member 4 are attached to the main body portion 2 (as shown in FIG. 1), the first cutting means 101 and the second cutting means 102 are accommodated and enclosed in a space defined by the main body portion 2, the first covering member 3 and the second covering member 4.

Figure 3:
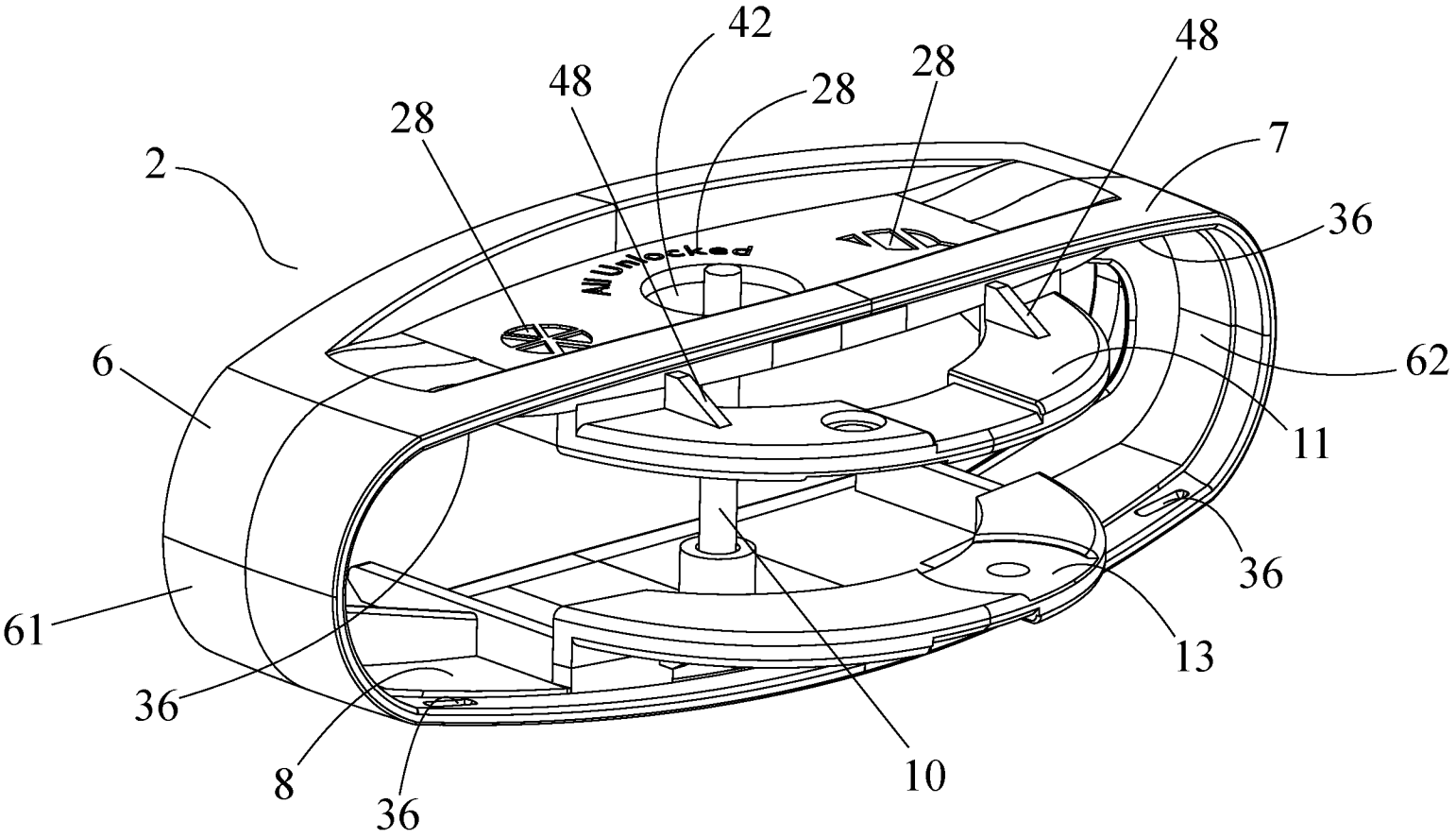
FIG. 3 is a perspective view of the main body portion of the cutting device shown in FIG. 1.

As can be seen in FIG. 3, the main body portion 2 comprises an annular frame 6 having a top plate 7, a bottom plate 8 and two opposite side plates 61, 62 connecting the top plate 7 and the bottom plate 8. A through hole 42 is drilled through the top plate 7. A main axle 10 extends from a center of the bottom plate 8 upwardly through the through hole 42 until an upper end of the main axle 10 is slightly above the top plate 7. As will be explained in the following, the main axle 10 is provided for the rotatable mounting of the locking mechanism 5 as well as the first cutting means 101. The main body portion 2 further comprises a first mounting plate 11 and a second mounting plate 13, both of which extend horizontally from a same side of the top plate 7 and the bottom plate 8. To be specific, both the first mounting plate 11 and the second mounting plate 13 extend from the side of the frame 6 on which the second covering member 4 is mounted. In other words, the first mounting plate 11 extends outwardly from below an inner surface of the top plate 7, and the second mounting plate 13 extends outwardly from above an inner surface of the bottom plate 8. Both the first mounting plate 11 and the second mounting plate 13 are formed to have a "C" shape, for the rotatable mounting of cutting members of the second cutting means 102, which will be described in greater details hereinbelow.

Figure 4:
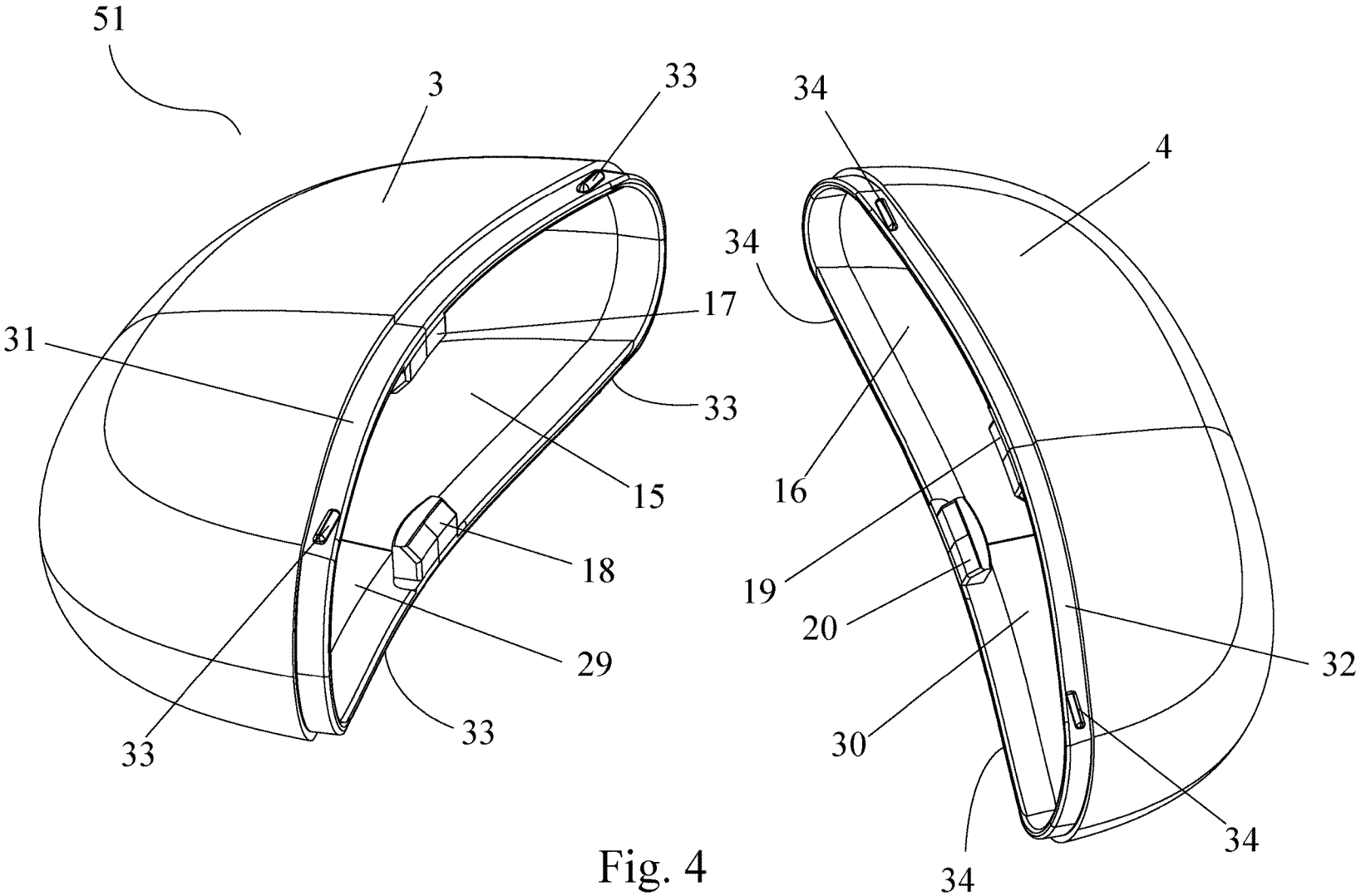
FIG. 4 is a perspective view of the first covering member and the second covering member of the cutting device shown in FIG. 1.
Figure 5:
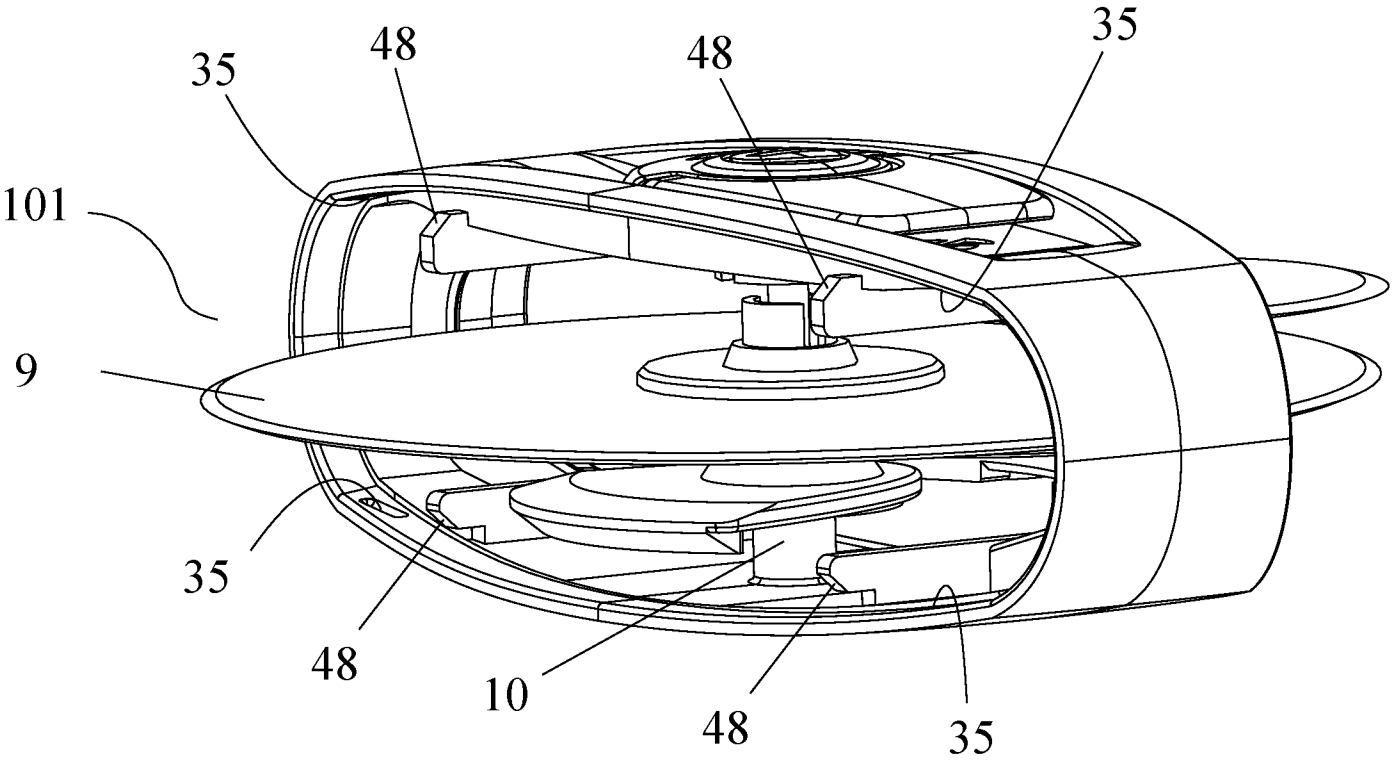
FIG. 5 is a side perspective view of the cutting device shown in FIG. 1, with the first covering member and the second covering member removed.
Figure 7:
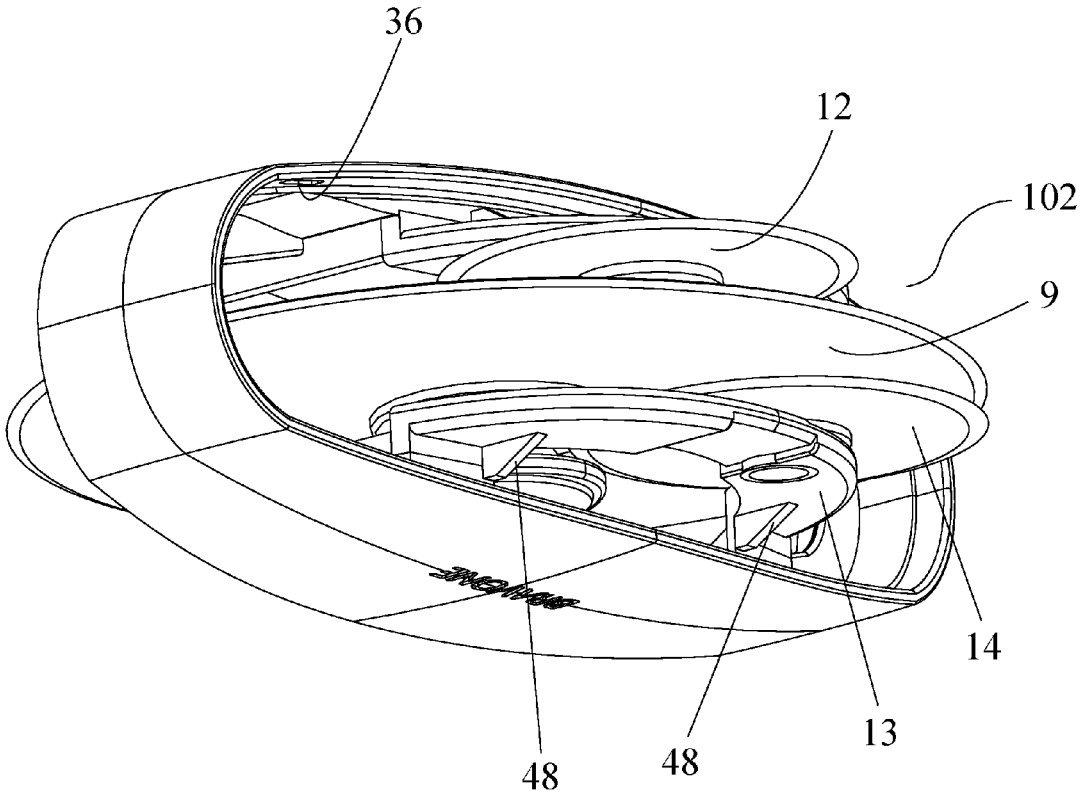
FIG. 7 is a bottom perspective view of the cutting device shown in FIG. 1, with the first covering member and the second covering member removed.

As shown in FIG. 4, both the first covering member 3 and the second covering member 4 have the shape of a half enclosure with an opening 29 and 30, respectively, and are adapted for the holding by a hand of a user. The first covering member 3 is formed to have a first cavity 15 for accommodating a half of the first cutting means 101 when attached to the main body portion 2, and the second covering member 4 is formed to have a second cavity 16 for accommodating a half of the first cutting means 101 and the second cutting means 102 when attached to the main body portion 2. An indented step 31 is formed at the periphery of the opening 29, such that when the first covering member 3 is attached to the main body portion 2, an outer surface of the first covering member 3 is flush with an outer surface of the main body portion 2. Four bumps 33 are formed on the step 31 to cooperate with corresponding pits 35 formed on an inner surface of the main body portion 2 (see FIG. 5) for snap-fit attachment of the first covering member 3 to the main body portion 2. Similarly, an indented step 32 is formed at the periphery of the opening 30 of the second covering member 4, and four bumps 34 are formed on the step 32 to cooperate with corresponding pits 36 formed on the inner surface of the main body portion 2 (see FIG. 3) for snap-fit attachment of the second covering member 4 to the main body portion 2. As can be seen in FIGS. 3, 5 and 7, a total of eight cam faces 48 are provided at both sides of the frame 6 to facilitate and guide the first covering member 3 and the second covering member 4 to move into snap-fit attachment with the main body portion 2.

Figure 6:
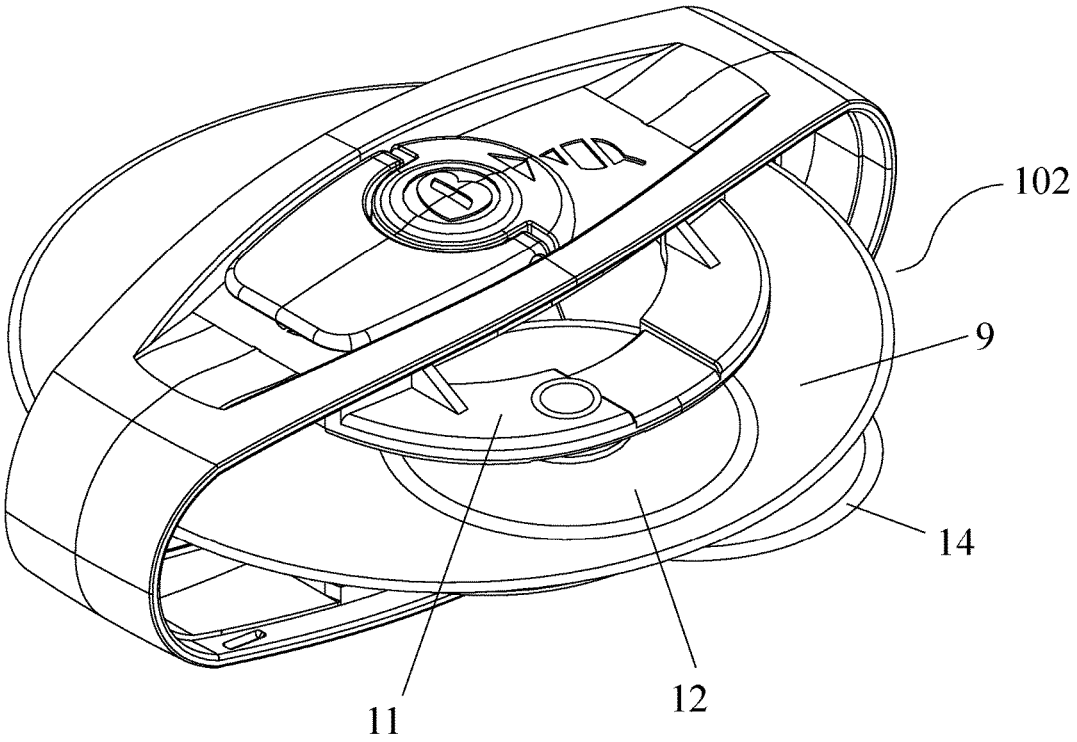
FIG. 6 is a top perspective view of the cutting device shown in FIG. 1, with the first covering member and the second covering member removed.

As shown in FIG. 5, the first cutting means 101 comprises a main cutting member 9 rotatably mounted on the main axle 10. The main cutting member 9 is provided as a circular blade for cutting pizza. The main axle 10 runs through a center of the main cutting member 9. As shown in FIGS. 6 and 7, the second cutting means 102 comprises a first auxiliary cutting member 12 rotatably mounted on the first mounting plate 11, and a second auxiliary cutting member 14 rotatably mounted on the second mounting plate 13. In this embodiment, the main cutting member 9 also serves as an additional cutting member of the second cutting means 102. Each of the first auxiliary cutting member 12 and the second auxiliary cutting member 14 is also provided as a circular blade for cutting foodstuff. Each of the first auxiliary cutting member 12 and the second auxiliary cutting member 14 has a diameter that is about half of the diameter of the main cutting member 9. As can be seen in FIG. 2, the main cutting member 9 extends transversely beyond the horizontal edges of the top and bottom plates 7, 8 at two opposite sides of the frame 6, while the first and second auxiliary cutting members 12, 14 extend transversely beyond the edges of the top and bottom plates 7, 8 on only one side of the frame 6.

Figure 8:
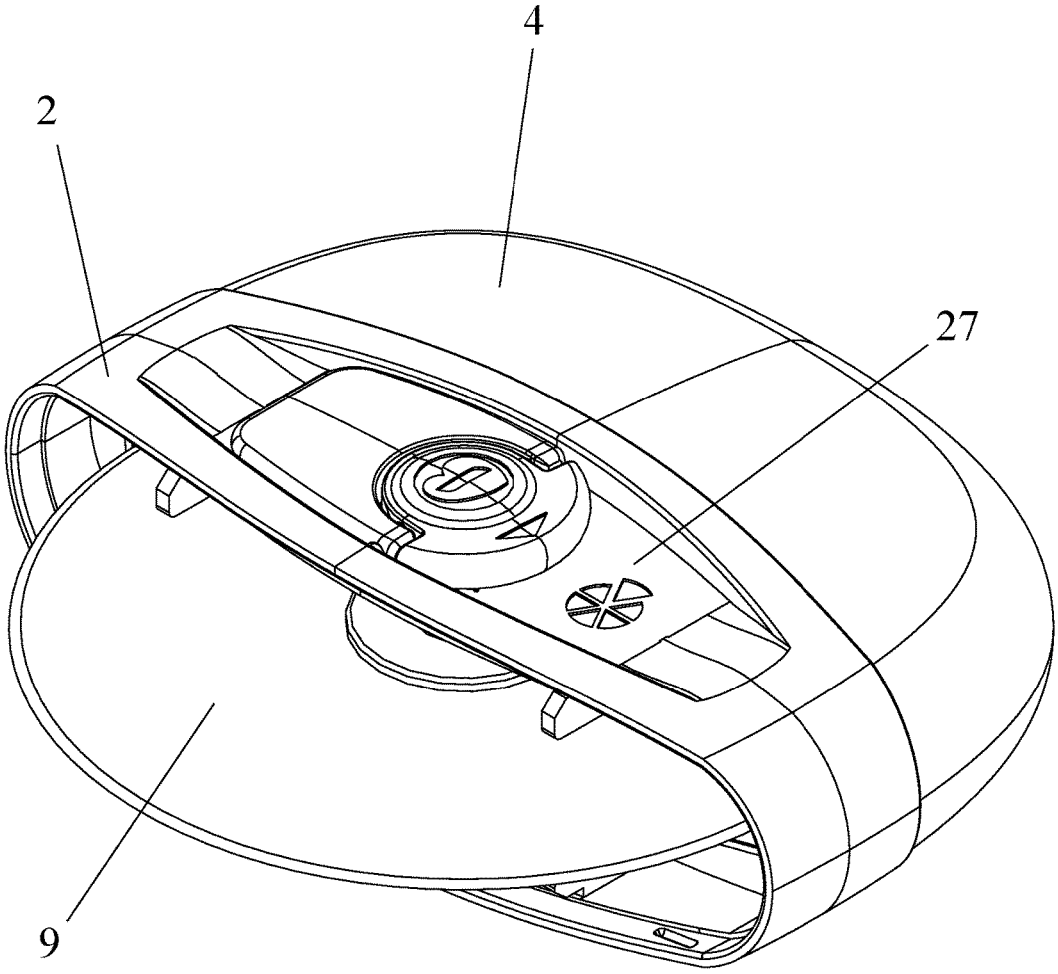
FIG. 8 is a perspective view of the cutting device shown in FIG. 1, with only the first covering member removed.

Now turning to FIG. 8, when the first covering member 3 is detached from the main body portion 2 and the second covering member 4 remains to be attached to the main body portion 2, about a half of the main cutting member 9 is exposed, while the other half of the main cutting member 9 as well as the first auxiliary cutting member 12 and the second auxiliary cutting member 14 all are accommodated in the second cavity 16 of the second covering member 4. A user can hold the cutting device 1 in this configuration by holding the main body portion 2 and the attached second covering member 4 to implement the cutting of foodstuffs, such as pizzas, into pieces or slices with the aid of the exposed half of the main cutting member 9. In this configuration, the second covering member 4 provides protection to the hand of the user by enclosing half of the main cutting member 9 as well as the first auxiliary cutting member 12 and the second auxiliary cutting member 14.

Figure 9:
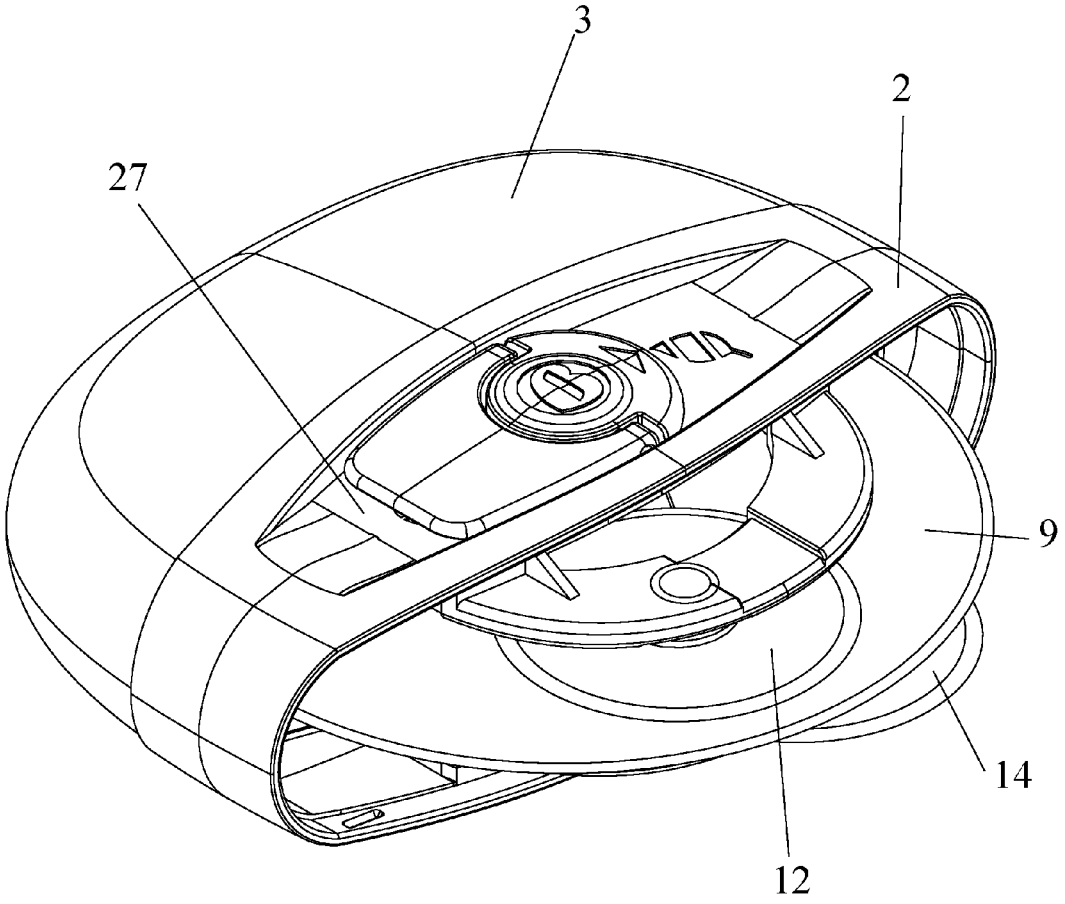
FIG. 9 is a perspective view of the cutting device shown in FIG. 1, with only the second covering member removed.

Likewise, FIG. 9 shows that the second covering member 4 is detached from the main body portion 2 while the first covering member 3 remains to be attached to the main body portion 2. In this case, about a half of the main cutting member 9 as well as the first auxiliary cutting member 12 and the second auxiliary cutting member 14 all are exposed, while the other half of the main cutting member 9 is accommodated in the first cavity 15 of the first covering member 3. The user can hold the cutting device 1 in this configuration by holding the main body portion 2 and the attached first covering member 3 to cut the foodstuffs with the aid of the exposed first auxiliary cutting member 12 and the exposed second auxiliary cutting member 14 as well as the exposed half of the main cutting member 9. In this case, three cutters are utilized at the same time, therefore the cutting device 1 is more suitable for cutting foodstuff such as herbs into small chips. In this configuration, the first covering member 3 provides protection to the hand of the user by enclosing the other half of the main cutting member 9.

Figure 10:
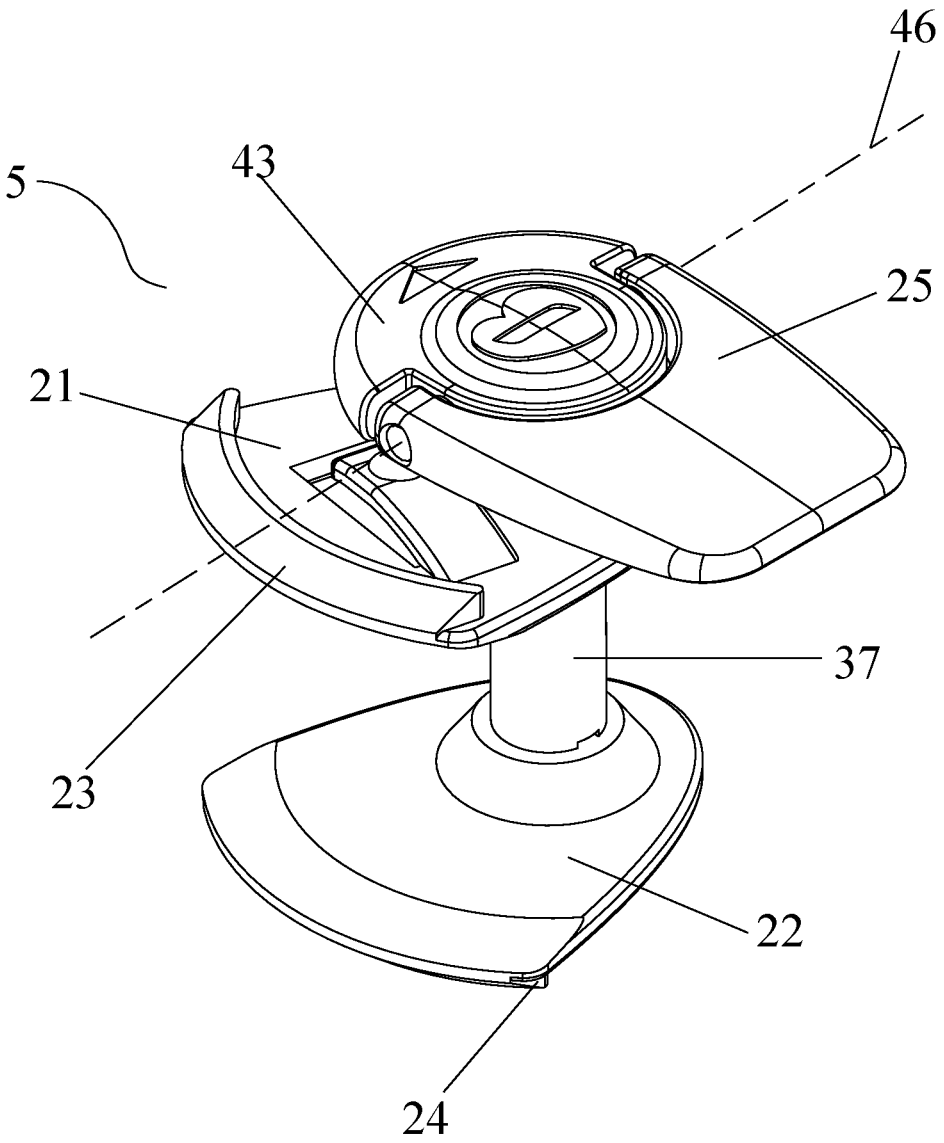
FIG. 10 is a perspective view of the locking mechanism of the cutting device shown in FIG. 1.
Figure 11:
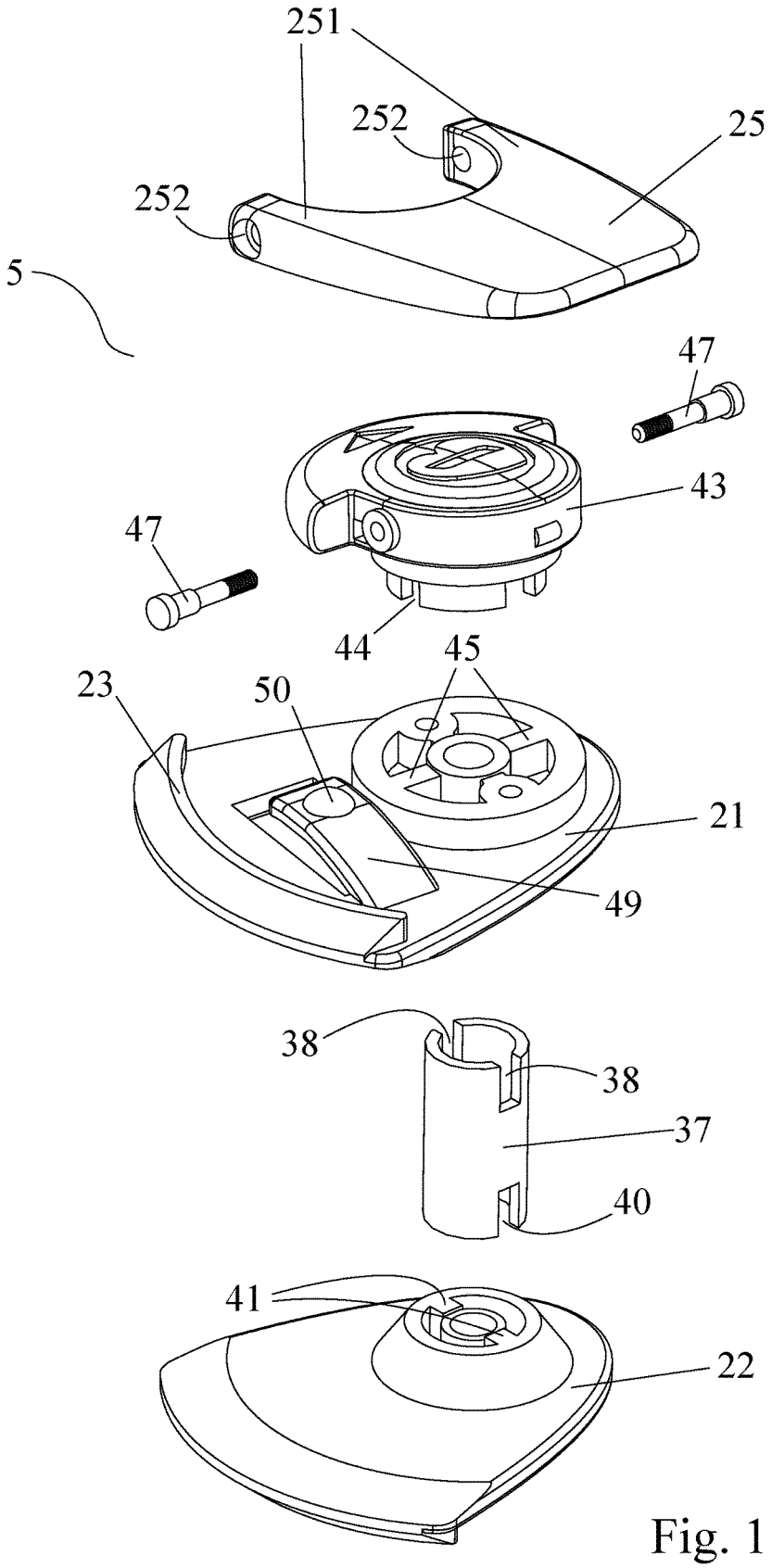
FIG. 11 is a top exploded perspective view of the locking mechanism of the cutting device shown in FIG. 1.
Figure 12:
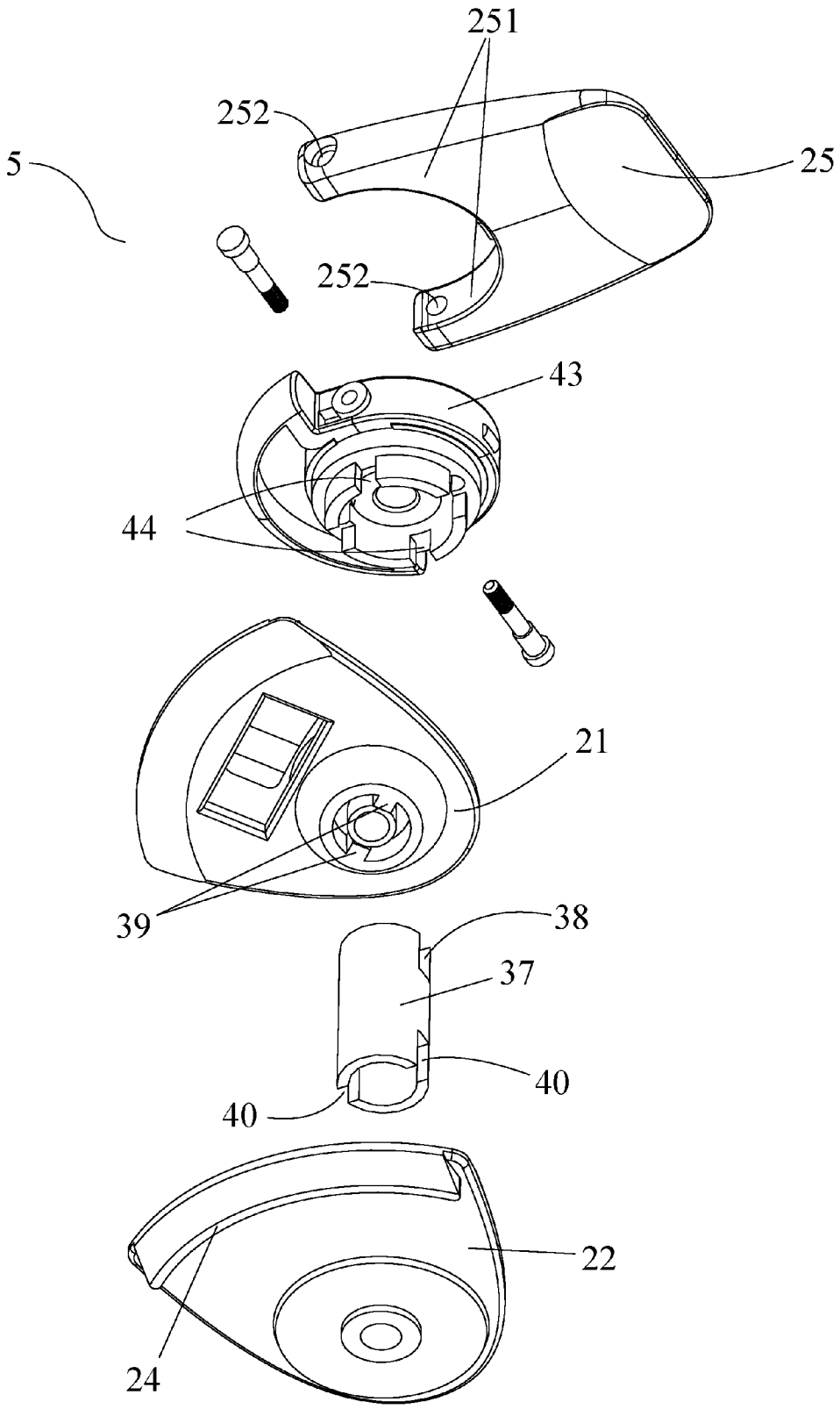
FIG. 12 is a bottom exploded perspective view of the locking mechanism of the cutting device shown in FIG. 1.

In addition to the protection from hurt to the user by the cutting means provided by the attached one of the covering members 3 and 4 when the cutting device 1 is in use as shown in FIGS. 8 and 9, a locking mechanism 5 is further provided to ensure that the attached one of the covering members will not be accidentally detached from the main body portion 2 causing hurt to the hand of the user by the cutting members. As shown in FIGS. 10-12, the locking mechanism 5 comprises a top locking member 21, a bottom locking member 22, and a handle 25, all mounted on the main axle 10 in a rotatable manner. Each of the top locking member 21 and the bottom locking member 22 is of the shape of a circular sector. An arcuated top tooth 23 is formed at an outer arcuated edge on a top surface of the top locking member 21, and an arcuated bottom tooth 24 is formed on a bottom surface of the bottom locking member 22.

The locking mechanism 5 comprises a sleeve 37 which is provided and rotatably mounted on the main axle 10, and the top locking member 21 and the bottom locking member 22 are fixedly attached to a top end and a bottom end, respectively, of the sleeve 37. To be specific, a pair of top slots 38 are formed at the top end of the sleeve 37 to receive a pair of projections 39 formed on a bottom surface of the top locking member 21, such that the top locking member 21 is not rotatable relative to the sleeve 37. Similarly, a pair of bottom slots 40 are formed at the bottom end of the sleeve 37 to receive a pair of projections 41 formed on a top surface of the bottom locking member 22, such that the bottom locking member 22 is not rotatable relative to the sleeve 37. The main cutting member 9 is also mounted on the sleeve 37 in such a manner that the main cutting member 9 is rotatable around the main axle 10 relative to the sleeve 37.

Figure 13:
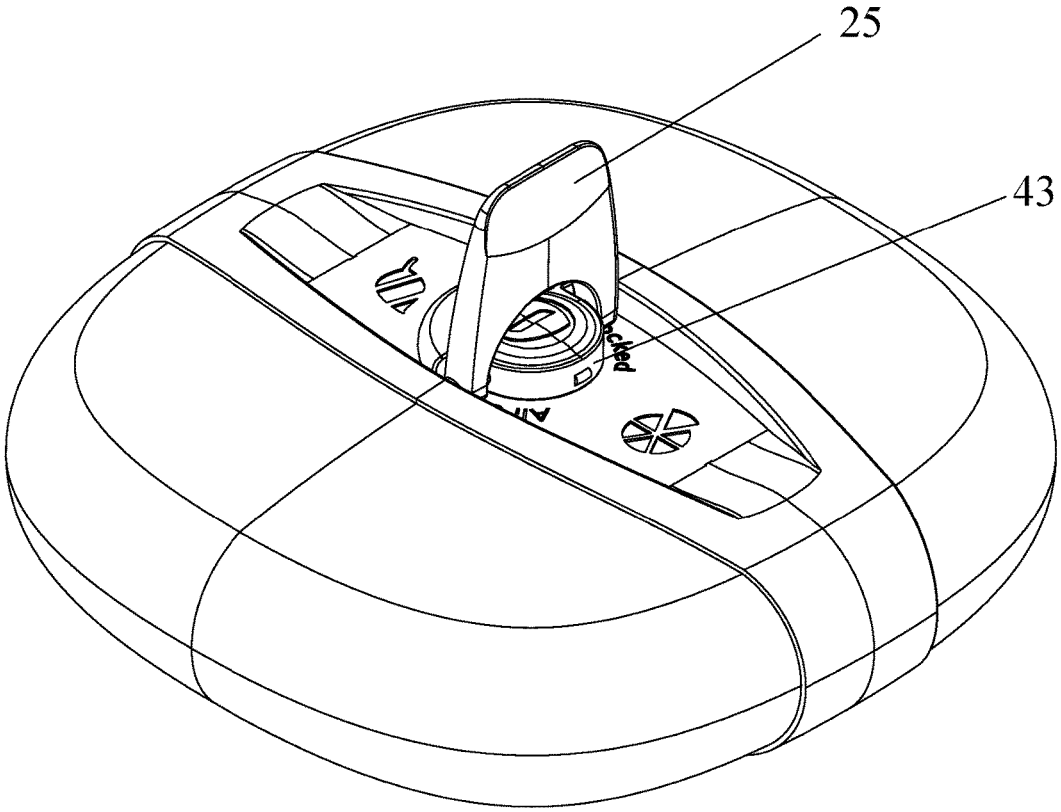
FIG. 13 is a perspective view of the cutting device shown in FIG. 1, with the handle in the upstanding position.
Figure 14:
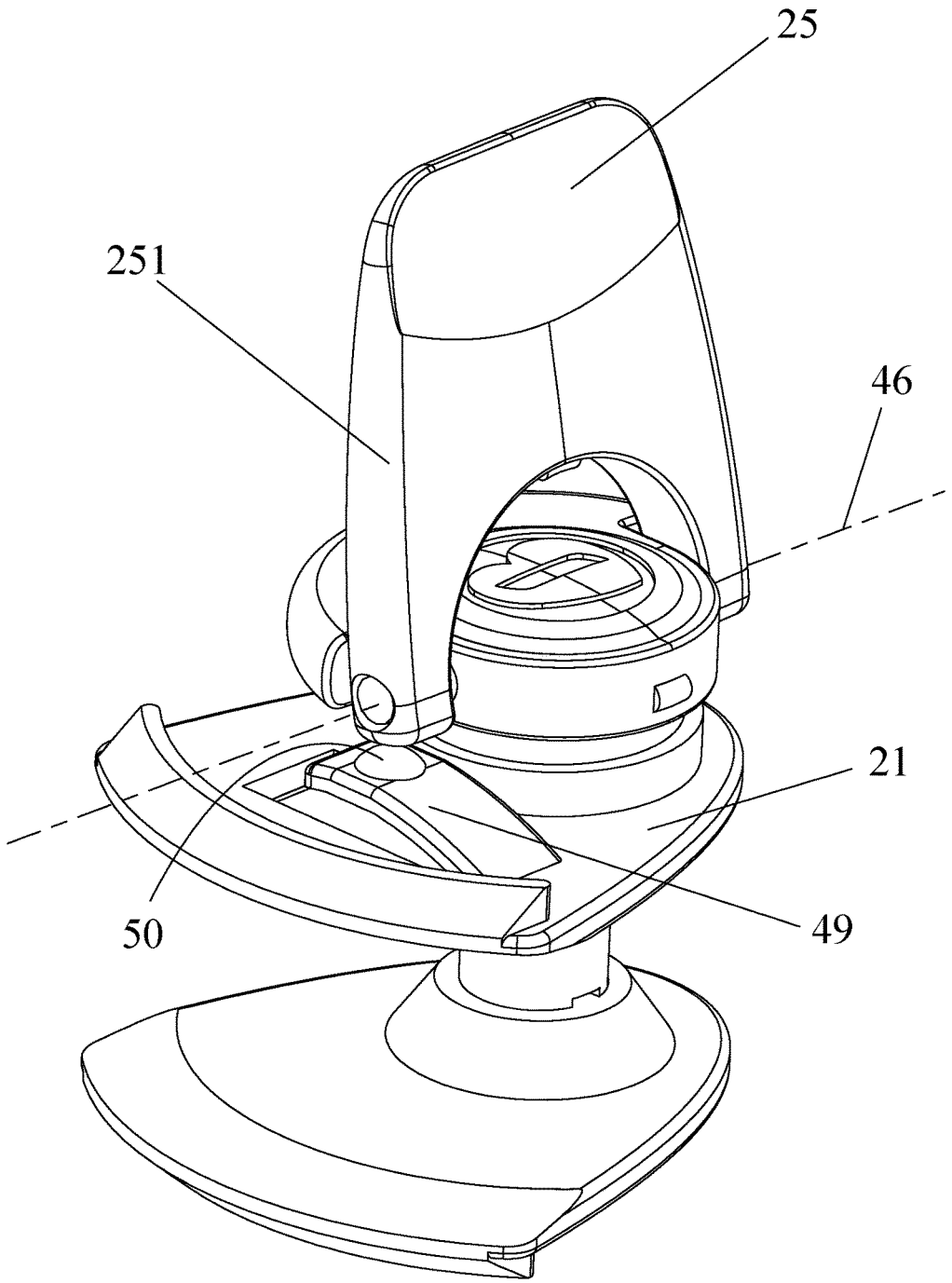
FIG. 14 is a perspective view of the locking mechanism of the cutting device shown in FIG. 1, with the handle in the upstanding position.
Figure 15:
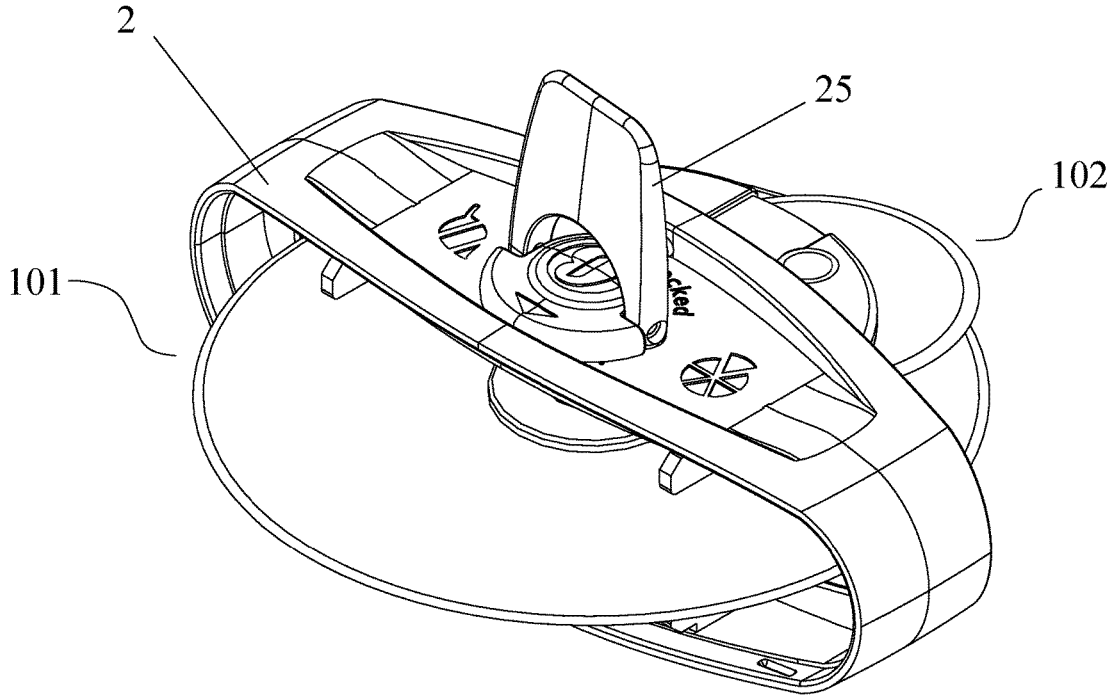
FIG. 15 is a perspective view of the cutting device shown in FIG. 1, with the locking mechanism rotated to a third position and the cover removed.

A collar 43 is fixedly attached to the top locking member 21 and extends upwardly through the through hole 42 of the top plate 7 of the main body portion 2 and beyond the top plate 7 (see FIG. 13). To be specific, a pair of notches 44 are formed on a bottom surface of the collar 43 to receive a pair of projections 45 formed on a top surface of the top locking member 21, such that the collar 43 is not rotatable relative to the top locking member 21. On top of the top plate 7, the handle 25 is attached to the collar 43 in such a manner that the handle 25 is rotatable together with the collar 43 around the main axle 10 and also pivotal relative to the collar 43 about a horizontal axis 46 perpendicular to the main axle 10 (see FIGS. 10 and 14). To be specific, the handle 25 comprises a pair of legs 251, and a traverse hole 252 is drilled at an outer end of each of the legs 251. A pin 47 passes through each of the traverse holes 252 and is screwed onto a respective side of the collar 43, such that the handle 25 is pivotal relative to the collar 43 about the axis 46 between a lying position as shown in FIGS. 1, 2, 6, 8, 9 and 10, and an upstanding position as shown in FIGS. 13, 14 and 15. A recess 27 is formed on the top surface of the top plate 7 to receive the handle 25 in the lying position (see FIGS. 8 and 9). Indicators 28 are provided on a surface of the recess 27 to indicate which position the locking mechanism 5 is in (best seen in FIG. 3).

In the upstanding position as shown in FIGS. 13 and 14, the handle 25 is better adapted for rotation by the user around the main axle 10. The rotation of the handle 25 around the main axle 10 causes the collar 43, and thus both the top locking member 21 and the bottom locking member 22, to rotate around the main axle 10 as well. Put simply, the locking mechanism 5 as a whole is caused to rotate around the main axle 10. When the locking mechanism 5 is rotated to a first position, the top tooth 23 engages with the second top bulge 19, and the bottom tooth 24 engages with the second bottom bulge 20, such that the second covering member 4 is prevented from being detached from the main body portion 2, while the first covering member 3 is allowed to be detached from the main body portion 2 (as shown in FIG. 8).

When the locking mechanism 5 is rotated to a second position, which is opposite to the first position, the top tooth 23 engages with the first top bulge 17, and the bottom tooth 24 engages with the first bottom bulge 18, such that the first covering member 3 is prevented from being detached from the main body portion 2, while the second covering member 4 is allowed to be detached from the main body portion 2 (as shown in FIG. 9).

When the locking mechanism 5 is rotated to a third position (as shown in FIG. 15) between the first position and the second position, the top tooth 23 is disengaged from both the first top bulge 17 and the second top bulge 19, and the bottom tooth 24 is disengaged from both the first bottom bulge 18 and the second bottom bulge 20, such that both the first covering member 3 and the second covering member 4 are allowed to be detached from the main body portion 2, facilitating easy access to the interior of the cutting device 1 for such purposes as cleaning.

Once the locking mechanism 5 is in the desired position for cutting (for example, the first position or the second position), the handle 25 may be pivoted into the lying position to provide the cutting device 1 with a flat outer surface when in use to facilitate the holding of the cutting device 1 by a hand of the user.

Alternatively, access to the interior can also be obtained by rotating the locking mechanism 5 to the first position and detaching the first covering member 3, and then rotating the locking mechanism 5 to the second position and detaching the second covering member 4.

As shown in FIGS. 11 and 14, a resilient member 49 is provided on a top surface of the top locking member 21 to maintain the handle 25 in the upstanding position. The resilient member 49 is formed as a curved projection extending obliquely and upwardly from the top surface of the top locking member 21 with a rounded apex 50 proximate to a top end thereof. When the handle 25 is pivoted into the upstanding position, the outer end of one of the legs 251 abuts against the rounded apex 50, and therefore an upward pressure is applied to the handle 25 to maintain it in the upstanding position, until a force is applied by the hand of the user to pivot the handle 25 into the lying position.

While the present invention is described in connection with what is presently considered to be the most practical and preferred embodiment, it should be appreciated that the invention is not limited to the disclosed embodiment, and is intended to cover various modifications and equivalent arrangements included within the spirit and scope of the claims. Modifications and variations in the present invention may be made without departing from the novel aspects of the invention as defined in the claims, and this application is limited only by the scope of the claims.

The invention claimed is:

1. A cutting device (1) for foodstuffs, comprising:

a main body portion (2), at least one first cutting means (101) and at least one second cutting means (102), both rotatably mounted on the main body portion (2) and adapted for cutting respective target foodstuffs, and a cover (51) detachably connected to the main body portion (2) to define an interior space for accommodating the first cutting means (101) and the second cutting means (102), said cover (51) comprising a first covering member (3) detachably attached to the main body portion (2) and configured in such a manner that the detachment of the first covering member (3) from the main body (2) allows for exposure of at least part of the first cutting means (101) to enable the cutting of foodstuffs, and a second covering member (4) detachably attached to the main body portion (2) and configured in such a manner that the detachment of the second covering member (4) from the main body (2) allows for exposure of at least part of the second cutting means (102) to enable the cutting of foodstuffs, wherein the first covering member (3) and the second covering member (4) are mounted on the main body portion (2) in a way which permits the detachment of one or both of the first and second covering members (3, 4) from the main body portion (2).

2. The cutting device of claim 1, further comprising a locking mechanism (5) arranged on the main body portion (2), the locking mechanism being displaceable among a first position, wherein the first covering member (34) is allowed to be detached from the main body portion (2) and the second covering member (4) is prevented from being detached from the main body portion (2); a second position, wherein the second covering member (4) is allowed to be detached from the main body portion (2) and the first covering member (3) is prevented from being detached from the main body portion (2); and a third position, wherein both the first covering member (3) and the second covering member (4) are allowed to be detached from the main body portion (2).

3. The cutting device of claim 2, wherein indicators (28) are provided on a top surface of the main body portion (2) to respectively indicate the first, second and third positions of the locking mechanism (5).

4. The cutting device of claim 2, wherein the main body portion (2) comprises an annular frame (6) having a top plate (7), a bottom plate (8) and two opposite side plates (61, 62) connecting the top plate (7) and the bottom plate (8), and the first cutting means (101) and the second cutting means (102) are arranged between the top plate (7) and the bottom plate (8), wherein the first cutting means (101) extends transversely beyond edges of the top and bottom plates (7, 8) at two opposite sides of the frame (6).

5. The cutting device of claim 4, wherein the first cutting means (101) comprises a main cutting member (9) rotatably mounted on a main axle (10) extending upwardly from the bottom plate (8) to protrude beyond the top plate (7), and the cutting of the foodstuffs is implemented by rotation of the main cutting member (9).

6. The cutting device of claim 5, wherein the second cutting means (102) comprises a first auxiliary cutting member (12) rotatably mounted on a first mounting plate (11) extending outwardly from below an inner surface of the top plate (7), and the cutting of the foodstuffs is implemented by rotation of the first auxiliary cutting member (12).

7. The cutting device of claim 6, wherein the main cutting member (9) is sized and configured to serve as a part of the second cutting means (102).

8. The cutting device of claim 6, wherein the second cutting means (102) further comprises a second auxiliary cutting member (14) rotatably mounted on a second mounting plate (13) extending outwardly from above an inner surface of the bottom plate (8) on the same side of the frame (6) as the first mounting plate (11), and the cutting of the foodstuffs is implemented by rotation of the first and second auxiliary cutting members (12, 14).

9. The cutting device of claim 8, wherein each of the main cutting member (9), the first auxiliary cutting member (12) and the second auxiliary cutting member (14) is provided as a circular blade, wherein the main cutting member (9) is sized and configured to extend transversely beyond the edges of the top and bottom plates (7, 8) at two opposite sides of the frame (6), and the first and second auxiliary cutting members (12, 14) are sized and configured such that they only extend transversely beyond the edges of the top and bottom plates (7, 8) on the same side of the frame (6) as the first and second mounting plate (11, 13).

10. The cutting device of claim 5, wherein the first covering member (3) is formed to have a first cavity (15) accommodating said at least part of the first cutting means (101), and the second covering member (4) is formed to have a second cavity (16) accommodating said at least part of the second cutting means (102).

11. The cutting device of claim 10, wherein a first top bulge (17) is formed on a top inner surface of the first covering member (3), and a first bottom bulge (18) is formed on a bottom inner surface of the first covering member (3), the first top bulge (17) and the first bottom bulge (18) being adapted to cooperate with the locking mechanism (5) to prevent the first covering member (3) from being detached from the main body portion (2) when the locking mechanism (5) is in the second position.

12. The cutting device of claim 11, wherein a second top bulge (19) is formed on a top inner surface of the second covering member (4), and a second bottom bulge (20) is formed on a bottom inner surface of the second covering member (4), the second top bulge (19) and the second bottom bulge (20) being adapted to cooperate with the locking mechanism (5) to prevent the second covering member (4) from being detached from the main body portion (2) when the locking mechanism (5) is in the first position.

13. The cutting device of claim 12, wherein the locking mechanism (5) comprises a top locking member (21) rotatably mounted on the main axle (10) between the main cutting member (9) and the top plate (7) of the main body portion (2), the top locking member (21) being adapted to engage with the first top bulge (17) to prevent the first covering member (3) from being detached from the main body portion (2) when the locking mechanism (5) is in the second position, and to engage with the second top bulge (19) to prevent the second covering member (4) from being detached from the main body portion (2) when the locking mechanism (5) is in the first position.

14. The cutting device of claim 13, wherein the locking mechanism (5) comprises a bottom locking member (22) rotatably mounted on the main axle (10) between the main cutting member (9) and the bottom plate (8) of the main body portion (2), the bottom locking member (22) being adapted to engage with the first bottom bulge (18) to prevent the first covering member (3) from being detached from the main body portion (2) when the locking mechanism (5) is in the second position, and to engage with the second bottom bulge (20) to prevent the second covering member (4) from being detached from the main body portion (2) when the locking mechanism (5) is in the first position.

15. The cutting device of claim 14, wherein the top locking member (21) is configured to be disengaged from both the first top bulge (17) and the second top bulge (19) when the locking mechanism (5) is in the third position, and the bottom locking member (22) is configured to be disengaged from both the first bottom bulge (18) and the second bottom bulge (20) when the locking mechanism (5) is in the third position.

16. The cutting device of claim 15, wherein each of the top locking member (21) and the bottom locking member (22) is provided as a circular sector having a respective arcuated tooth (23, 24) formed at an outer arcuated edge thereof to cooperate with the corresponding ones of the first top bulge (17), the second top bulge (19), the first bottom bulge (18) and the second bottom bulge (20).

17. The cutting device of claim 14, wherein the locking mechanism (5) further comprises a handle (25) provided on top of the top plate (7) of the main body portion (2), wherein the handle (25) is configured to be rotatable around the main axle (10), and the rotation of the handle (25) causes the rotation of the top locking member (21) and the bottom locking member (22).

18. The cutting device of claim 17, wherein the handle (25) is configured to be pivotal around an axis (46) perpendicular to the main axle (10) between an upstanding position, wherein the handle (25) is rotatable around the main axle (10), and a lying position, wherein the handle (25) is received in a recess (27) formed on a top surface of the top plate (7) of the main body portion (2).

19. The cutting device of claim 1, wherein the first covering member (3) and the second covering member (4) are attached to the main body portion (2) by snap-fit.

* * * * *